United States Patent [19]

Nishio et al.

[11] Patent Number: 4,667,858

[45] Date of Patent: May 26, 1987

[54] FILLER MATERIAL FOR FILLING AN OUTLET APERTURE OF A CASTING LADLE OR SIMILAR CONTAINER AND A PROCESS FOR PRODUCING THE FILLER MATERIAL

[75] Inventors: Takumi Nishio, Toyota; Takahiro Katayose, Kariya, both of Japan

[73] Assignee: Toshiba Ceramics Co., Ltd., Tokyo, Japan

[21] Appl. No.: 814,176

[22] Filed: Dec. 24, 1985

Related U.S. Application Data

[63] Continuation of Ser. No. 567,672, Jan. 3, 1984, abandoned.

[30] Foreign Application Priority Data

Aug. 5, 1983 [JP] Japan ..... 58-143290

[51] Int. Cl.[4] ..... B22D 41/00

[52] U.S. Cl. ..... 222/591; 106/308 B; 427/189; 427/190; 427/193; 427/201; 428/403; 428/404; 428/407; 428/323; 428/328; 428/212

[58] Field of Search ..... 427/189, 190, 193, 201; 428/403, 404, 407, 323, 328; 106/308 B; 222/590, 591, 600

[56] References Cited

U.S. PATENT DOCUMENTS 4,113,501 9/1978 Edamoto ..... 222/590

FOREIGN PATENT DOCUMENTS

| | | | |
|---|---|---|---|
| 0017430 | 5/1968 | Japan | 222/590 |
| 0030890 | 5/1968 | Japan | 222/591 |
| 6802 | 3/1970 | Japan . | |
| 0003731 | 2/1978 | Japan | 222/600 |
| 5828 | 1/1979 | Japan . | |
| 0001262 | 6/1979 | Japan | 222/590 |
| 0018194 | 5/1980 | Japan | 222/590 |
| 0139466 | 2/1981 | Japan | 222/600 |
| 0188469 | 5/1981 | Japan | 222/591 |
| 0015085 | 7/1981 | Japan | 222/591 |
| 0050269 | 3/1982 | Japan | 222/600 |
| 434520 | of 1935 | United Kingdom | 222/591 |
| 2019542 | 10/1979 | United Kingdom | 222/590 |
| 1581058 | 12/1980 | United Kingdom | 222/590 |

*Primary Examiner*—George F. Lesmes
*Assistant Examiner*—William M. Atkinson
*Attorney, Agent, or Firm*—Oblon, Fisher, Spivak, McClelland & Maier

[57] ABSTRACT

A filler material for filling an outlet aperture of a casting ladle or similar container, comprising a particulate core principally composed of quartz and a coating layer which covers a surface of the core, the coating layer having a multiplicity of fine particles principally made of at least one material selected from materials of feldspar group can be surely taken off from the outlet aperture of a casting ladle or other similar container to allow substantially complete opening of the aperture when the slide gate is opened.

11 Claims, 1 Drawing Figure

Figure 1:
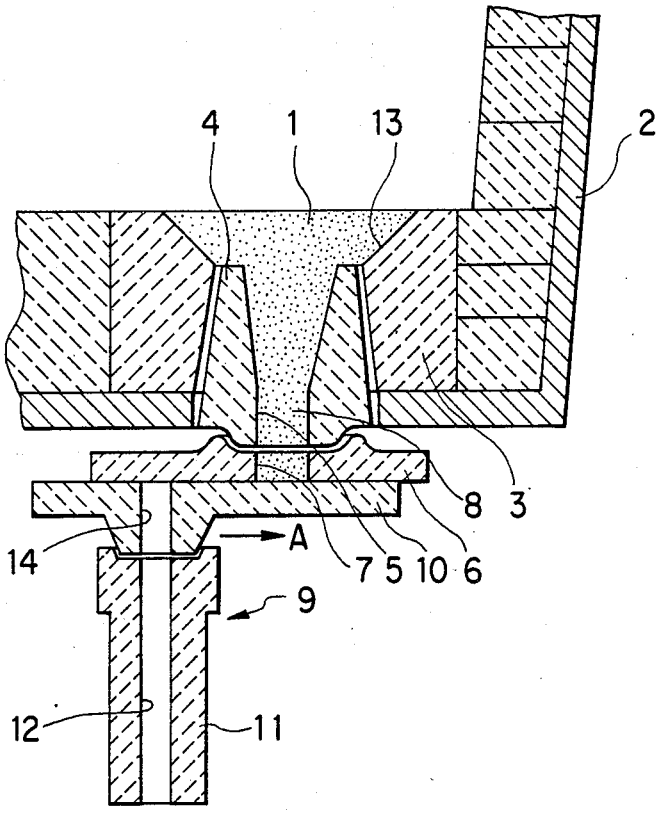

FILLER MATERIAL FOR FILLING AN OUTLET APERTURE OF A CASTING LADLE OR SIMILAR CONTAINER AND A PROCESS FOR PRODUCING THE FILLER MATERIAL

This application is a continuation of application Ser. No. 567,672, filed Jan. 3, 1984, now abandoned.

This invention relates to a filler material for filling an outlet aperture of a casting ladle or other similar container such as a tundish used for continuous casting of a molten metal such as molten steel and designed such that the outlet aperture is opened and closed by a slide gate, that is, by a slide plate of the gate. More particularly, this invention relates to a filler material of the type used for filling the outlet aperture of a casting ladle or other similar container before charging a molten metal into the casting ladle or similar container for preventing the outlet aperture from being blocked by the solidified metal or other causes, the filler particle being adapted such that, upon opening of the slide gate, the filler drops off entirely from the outlet aperture to let it open fully before effluxion or discharge of the molten metal. The present invention also provides a process for producing such filler material.

The slide gate is provided just below the bottom wall portion of the casting ladle or similar container such as the tundish for controlling the efflux or discharge of the molten metal from the casting ladle or similar container. Two-plate slide gate generally comprises a stationary plate fixed on the underside of the bottom portion and having an aperture in alignment with an aperture of a top nozzle disposed in a bottom well blocks of the bottom wall portion of the ladle or similar container, a slide plate having an aperture and being arranged slidable relative to the stationary or upper plate so as to communicate or shut off the apertures in the top nozzle and the stationary plate with the outside, and a submerged nozzle secured to the slide plate, the aperture of the submerged nozzle being aligned with the aperture of the slide plate.

In this specification of the invention, the "outlet aperture" of a casting ladle or similar container is referred to as the apertures in the bottom well blocks and/or the top nozzle and/or the stationary plate of the slide gate. The slide gate may be a two-plate system or a three-plate system.

Conventionally, graphite particles, natural siliceous sand particles or finely divided particles of iron oxide have been used as the filler material. These conventional filler materials, however, involved some serious problems in their use. For instance, there was fear that the filler material filled in the outlet aperture might be forced to float up by the violent flow of the molten steel in a ladle when the molten steel was poured into the ladle or that the particles of the filler material might be rigidly sintered to each other or to the peripheral wall of the outlet aperture by the heat of the poured molten steel, keeping the outlet aperture substantially closed even when the slide gate is opened.

In an attempt to overcome these problems, use of a filler material comprising as its principal constituents 80 to 94% by weight of $SiO_2$ and 2 to 12% by weight of oxides of alkali metal and/or alkaline-earth metal and having a particle size of 0.5 to 2.5 mm has been proposed. This filler material is a mixture of particles or a mixed powder consisting preferably of siliceous sand particles and the particles of an alkali-containing substance such as feldspar, the particles being mixed in a non-aggregated state.

Such filler material is, however, still disadvantageous on points that the siliceous sand particles and feldspar particles are hard to be mixed uniformly and that when small amounts of mixed particles are sampled as the lots of the filler material, such lots would have different proportions of siliceous sand particles and feldspar particles.

If the proportion or ratio of siliceous sand particles in the sampled lot of the filler material is greater than a desired level or ratio, the filler material mainly including the siliceous sand particles and filled in the outlet aperture may not be sintered sufficiently by the heat of the charged molten metal such as molten steel, allowing the molten steel to enter and solidify in the spaces between the particles of the filler material. Therefore the outlet aperture would fail to be opened sufficiently even when the slide gate is opened.

On the other hand, if the proportion ratio of the feldspar particles in the sampled lot of the filler material is greater than a desired ratio, the degree of sintering of the filler particles may become so high, which leads to an insufficient opening of the outlet aperture when the slide gate is opened.

Thus, in actual use of the samples of the proposed filler material, the ratio or degree of opening of the outlet aperture as attained when opening the slide gate was about 95 to 98%.

The term "ratio of opening of the outlet" or "ratio of opening" as used in this specification means the ratio of a heat number or successful number of times when the molten metal started to be discharged simultaneously with the drop of the filler material from the outlet aperture on opening the slide gate with respect to a total heat number or total number of times when the slide gate was opened so as to discharge the molten metal as well as to drop the filler material, in which the case where the molten metal was not discharged even though the filler material was dropped, or for example the case oxygen lancing or burning was used for opening the outlet aperture was not counted as the successful number of times This invention has been made so as to at least reduce the above-mentioned problems, and the object of this invention is to provide a filler material for the outlet aperture of the casting ladle or other similar container, which filler material ensures substantially full or complete opening of the outlet aperture when the slide gate is opened.

According to this invention, the above-mentioned object can be accomplished by a filler material for filling an outlet aperture of a casting ladle or similar container, comprising a particulate core principally composed of quartz and a coating layer which covers a surface of the core, the coating layer having a multiplicity of fine particles principally made of at least one material selected from materials of feldspar group.

In the filler material or in each particle of the filler material according to this invention, the particulate core principally made of quartz is coated with a multiplicity of fine particles principally including at least one material selected from materials of feldspar group. Therefore, in any optionally sampled small amount of filler material or particles and at any part of the sampled filler material, the mixed ratio or proportion of quartz and alkali components such as $K_2O$ and/or $Na_2O$, in other words, the mixed ratio of siliceous sand and the material of feldspar group is substantially constant, that is, the mixed state of the component materials is kept uniform.

Further, since each core portion in the form of a particle principally made of quartz is coated with the fine particles principally composed of the material of the feldspar group which has a lower melting point than the core material, the core portions of the adjoining or adjacent filler particles are moderately sintered through the feldspar particles forming the respective core-coating layers, thanks to the compatibility or easy solubility between the core material (mostly quartz) and the material of the feldspar group.

Therefore, when the filler material consisting of the filler particles according to this invention is used for filling the outlet aperture of the casting ladle or similar container, not only the penetration of the molten metal in between the filler particles can be avoided in the entire area filled by the filler material but also sintering of high mechanical strength between the particles of the core material or quartz can be prevented, ensuring to open the outlet aperture at a high ratio of opening when the slide gate is opened.

According to this invention, the filler material described above can be produced by a process comprising a step of applying a multiplicity of fine particles principally made of at least one material selected from materials of feldspar group to surfaces of core particles principally composed of quartz by means of a binder.

According to this invention, the fine particles principally composed of the material or materials of the feldspar group are preferably those having the melting point or points of 1,000° to 1,700° C. so that such particles would be easily sintered in the outlet aperture by the heat of a molten metal such as molten steel and/or that the fine particles would be partially fused or melted so as to make the bonds between sintered particles relatively weak. Actually, it may be selected such that the fine particles should have the melting point near the temperature of the molten metal such as molten steel in the casting ladle or similar container. The fine particles may consist of the material or materials of the feldspar group alone, but a part of feldspar powder, for example, not more than 60 weight % thereof may be replaced with other refractory material such as pottery stone, alumina, chamotte, etc., provided that the fine particles are principally made the material or materials of the feldspar group.

According to this invention, the fine particles forming the coating layer of the filler particle preferably small enough to pass through a Tyler standard sieve of 100 meshes (0.147 mm) so that, in case molten steel of a temperature of about 1,650° C. is used as the molten metal, the filler particles can be sintered in the outlet aperture in a short time by the heat of the molten steel and sintered filler particles have a relatively weak mechanical strength such that the sintered filler particles can be easily broken under the load or pressure of the molten steel when the slide gate is opened.

The core material principally composed of quartz preferably consists essentially of siliceous sand in view of availability and easiness to be sintered with the fine coating particles principally made of the material of the feldspar group.

According to this invention, the fine particles principally made of at least one material of the feldspar group are applied in an amount of 5 to 30% by weight with respect to the weight of the core made of the siliceous sand, so that the filler particles will be sintered relatively quickly and to a moderate mechanical strength in the outlet aperture. If this weight ratio of the fine particles is less than 5% by weight or greater than 30% by weight, the sintering of the filler material may not be effected at a desired speed or to a desired mechanical strength.

In order that a substantially perfect coating layer may be formed by the fine particles principally made of the feldspar and that the spaces between the cores in the form of the particles may be filled up by 5 to 30% by weight of sintered feldspar, the core particles preferably have a size of 0.5 to 3.5 mm.

Hereinafter, the invention will be described in more detail by referring to the accompanying drawing, by which the foregoing and other objects, as well as the features of this invention will be made clearer, in which:

FIG. 1 is an illustrative sectional view of a part of a ladle with a 2-plate slide gate, in which the outlet aperture of the ladle is filled by the filler particles according to this invention.

EXAMPLE

Feldspar with an alkali content (oxides of alkali metal and/or alkali-earth metal) of 10 - 13% by weight (typically $SiO_2$: 75 8%, $Al_2O_3$: 12.8%, $Na_2O$: 1.9%, $K_2O$: 8.4%) produced in Gifu Prefecture of Japan was pulverized into fine particles of the sizes small enough to pass through a Tyler standard sieve of 100 meshes (0.147 mm). The average particle size of these fine particles was just about same as the opening of the Tyler standard sieve of 200 meshes (0.074 mm).

The fine particles of feldspar thus obtained were blended with, at a ratio of 15% by weight to, the siliceous sand particles with sizes of 0.5–4.0 mm which were to form the particulate cores of the filler material, and then a 1% aqueous solution of CMC (carboxymethyl cellulose or a sodium derivative thereof) were added to the blended particles as a binder in an amount of 5% by weight with respect to the siliceous sand particles. The blended and added materials were mixed well and dried by heating at 300°–500° C. in the air, whereby there was obtained a filler material 1 consisting of the filler particles each comprising the core of siliceous sand covered with fine particles of feldspar.

At the first step, the filler material 1 were filled in an aperture 7 in a stationary plate 6 in an aperture 5 of the top nozzle 4 as well as in a frusto-conical aperture 13 of the well blocks 3 at the bottom of the casting ladle 2, in a state where the outlet aperture 8 comprising the apertures 5, 7, 13 was closed by a slide plate 10 of a 2-plate silde gate 9. In the ladle system the stationary plate 6 of the slide gate 9 was secured to the underside of the bottom wall portion of the ladle 2, the aperture 7 being aligned with the aperture 5. All of the well blocks 3 at the bottom of the ladle 2, the top nozzle 4, the stationary plate 6 and slide plate 10 were made of a refractory composed of 90% by weight of alumina and 10% by weight of silica.

Then, at the second step, molten steel of about 1,680° C. was poured into said ladle 2.

At the third step about 90 minutes after the pouring, the slide plate 10 and a submerged nozzle 12 integral with the plate 10 were moved in the direction of A relative to the ladle 2 so as to open the gate 9 or so as to align an aperture 14 in the slide plate 10 and an aperture 12 of the submerged nozzle 11 with the outlet aperture 8, thereby allowing the filler material 1 and the molten steel to be discharged to the outside through the apertures 8, 14, 12.

The above-mentioned three steps of operation was repeated 300 times. The average ratio of opening of the outlet aperture 8 for 300 times of operation was 99%.

COMPARATIVE EXAMPLE

Same feldspar as used in the foregoing Example was pulverized into the particles with sizes of 0.4 to 4.0 mm and these feldspar particles were mixed with the same siliceous sand particles (0.5–4.0 mm in particle size) as used in the abovementioned Example such that the weight ratio of feldspar would become 15% with respect to the siliceous sand, thereby preparing a filler material of the comparative example.

This filler material of the comparative example was subjected to the above-mentioned three steps of operation repeatedly. The average ratio of opening of the outlet aperture 8 as determined after 300 times of the three-step operations was 97%.

In the Example described above, in order to obtain the filler material of a preferred embodiment of this invention, an aqueous solution of CMC was used as binder, but it is possible to use other types of organic binders such as epoxy resin, phenolic resin, silicone resin, unsaturated polyester resin, urea resin or formaldehyde resin, or inorganic binders such as silica sol, alimina sol, sodium silicate, potassium silicate, aliminum phosphate or sodium phosphate in place of CMC.

Furthermore, in the above-mentioned Example, drying was conducted at a temperature of 300–500° C., but the drying temperature may be higher or lower than this range; for example, it may be room temperature.

What is claimed is:

1. A process for producing filler material for filling an outlet aperture of a casting ladle or similar container, comprising a step of applying a multiplicity of fine particles principally made of at least one material selected from feldspar minerals having an alkali content of 10–13% by weight to the surface of core particles consisting essentially of silica by means of a binder, the size of the core being 0.5 to 4.0 mm, each fine particle forming the coating layer having a size small enough to pass through a Tyler standard sieve of 100 meshes (0.147 mm), and said multiplicity of fine particles being 5 to 30 percent of weight of the core particles.

2. The process according to claim 1, wherein the applying step comprises mixing a multiplicity of said core particles and a multiplicity of said fine particles with said binder to form a mixture and drying said mixture

3. The process according to claim 1, wherein the size of the core is 0.5 to 3.5 mm.

4. In a casting ladle or similar container of a type in which the outlet aperture is opened or closed by a slide plate, and is filled during operation with a filler material, an improvement which comprises said filler material comprising a particulate core consisting essentially of silica and a coating layer comprising a multiplicity of fine particles and a suitable binder, said fine particles being principally made up of at least one material selected from feldspar minerals having an alkali content of 10–13% by weight, the size of the core being 0.5 to 4.0 mm, each fine particle forming the coating layer having a size small enough to pass through a Tyler standard sieve of 100 meshes (0.147 mm), and the overall weight of said fine particles forming said coating layer being between 5 and 30% of the weight of said core particles.

5. The casting ladle or similar container of claim 4, wherein the fine particles forming the coating layer have a melting point at a temperature between 1000? C. and 1700° C.

6. The coating ladle or similar container of claim 5, wherein the core consists of siliceous sand.

7. The casting ladle or similar container of claim 6, wherein the core particles have a size of from 0.5 to 3.5 mm.

8. A filler material for filling an outlet aperture of a casting ladle or similar container, said filler material comprising a particulate core consisting essentially of silica and a coating layer comprising a multiplicity of fine particles and a suitable binder, said fine particle being principally made of at least one material selected from feldspar minerals having an alkali content of 10–13% by weight, the size of the core being 0.5 to 4.0 mm, each fine particle forming the coating layer having a size small enought to pass through a Tyler standard sieve of 100 meshes (0.147 mm), and the overall weight of said fine particles forming said coating layer being between 5 and 30 percent of the weight of said core particles.

9. The filler material according to claim 8, wherein the fine particles forming the coating layer have a melting point at a temperature between 1,000° C. and 1,700° C.

10. The filler material according to claim 9, wherein the core consists of siliceous sand.

11. The filler material according to claim 10 wherein the size of the core is 0.5 to 3.5 mm.

* * * * *